US010213056B1

(12) United States Patent
Gallo

(10) Patent No.: US 10,213,056 B1
(45) Date of Patent: Feb. 26, 2019

(54) BATHROOM SUPPORT SYSTEM

(71) Applicant: Gerald F. Gallo, Worcester, MA (US)

(72) Inventor: Gerald F. Gallo, Worcester, MA (US)

( * ) Notice: Subject to any disclaimer, the term of this patent is extended or adjusted under 35 U.S.C. 154(b) by 0 days.

(21) Appl. No.: 15/865,345

(22) Filed: Jan. 9, 2018

(51) Int. Cl.

| | |
|---|---|
| ***A47K 3/00*** | (2006.01) |
| ***A47K 10/04*** | (2006.01) |
| ***G08B 21/04*** | (2006.01) |
| ***E03C 1/04*** | (2006.01) |

(52) U.S. Cl.
CPC ..... *A47K 3/001* (2013.01); *A47K 3/003* (2013.01); *A47K 10/04* (2013.01); *E03C 1/0409* (2013.01); *G08B 21/0461* (2013.01); *A47K 2201/00* (2013.01)

(58) Field of Classification Search
CPC ..... A47K 3/001; A47K 3/003; A47K 10/04; A47K 2201/00; E03C 1/0409; G08B 21/0461
USPC ..... 4/546, 560.1
See application file for complete search history.

(56) References Cited

U.S. PATENT DOCUMENTS

| | | | | |
|---|---|---|---|---|
| 3,996,631 | A * | 12/1976 | Fields | A47K 3/001 4/576.1 |
| 3,999,565 | A | 12/1976 | Delacour | |
| 4,062,372 | A | 12/1977 | Slusher | |
| D531,399 | S | 11/2006 | Olerud | |
| 7,344,320 | B2 | 3/2008 | Barker | |
| 8,371,320 | B1 | 2/2013 | McKenna | |
| 9,038,647 | B1 | 5/2015 | Scott | |
| 9,468,272 | B1 | 10/2016 | Hyde | |
| 2008/0222791 | A1* | 9/2008 | Godbersen | A47K 3/003 4/576.1 |

* cited by examiner

*Primary Examiner* — Tuan N Nguyen
(74) *Attorney, Agent, or Firm* — Kyle A. Fletcher, Esq.

(57) ABSTRACT

The bathroom support system is a stability assistance device. The bathroom support system is removably installed in the bathing structure. An individual uses the bathroom support system as a supporting structure by holding onto the bathroom support system during bathing activities. The bathroom support system comprises a telescopic structure, a plurality of supports, and an alarm system. The plurality of supports and the alarm system attach to the telescopic structure. The telescopic structure adjusts the size of the bathroom support system to match the space provided in the bathing structure. The plurality of supports: 1) stabilize the bathroom support system; and, 2) provide anchor points, which are grasped by the individual for stabilization. The alarm system is a safety device that allows the individual to call for assistance from an appropriate authority if it is required.

18 Claims, 7 Drawing Sheets

COTTER PIN

SPRING LOADED BALL LOCK

G SNAP COLLAR

SPLIT COLLAR LOCK

THREADED CLUTCH

INTERNAL CAM LOCK

BATHROOM SUPPORT SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including baths and related appurtenances, more specifically, a grip configured for use in a bath.

SUMMARY OF INVENTION

The bathroom support system is a stability assistance device. The bathroom support system is configured for use in a bathing structure selected from the group consisting of a bathtub or a shower. The bathroom support system is removably installed in the bathing structure. The bathroom support system is adapted for use by an individual. The individual uses the bathroom support system as a supporting structure by holding onto the bathroom support system during bathing activities. The bathroom support system comprises a telescopic structure, a plurality of supports, and an alarm system. The plurality of supports and the alarm system attach to the telescopic structure. The telescopic structure adjusts the size of the bathroom support system to match the space provided in the bathing structure. The plurality of supports: 1) stabilize the bathroom support system; and, 2) provide anchor points which are grasped by the individual for stabilization. The alarm system is a safety device that allows the individual to call for assistance from an appropriate authority if it is required.

These together with additional objects, features and advantages of the bathroom support system will be readily apparent to those of ordinary skill in the art upon reading the following detailed description of the presently preferred, but nonetheless illustrative, embodiments when taken in conjunction with the accompanying drawings.

In this respect, before explaining the current embodiments of the bathroom support system in detail, it is to be understood that the bathroom support system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bathroom support system.

It is therefore important that the claims be regarded as including such equivalent construction insofar as they do not depart from the spirit and scope of the bathroom support system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
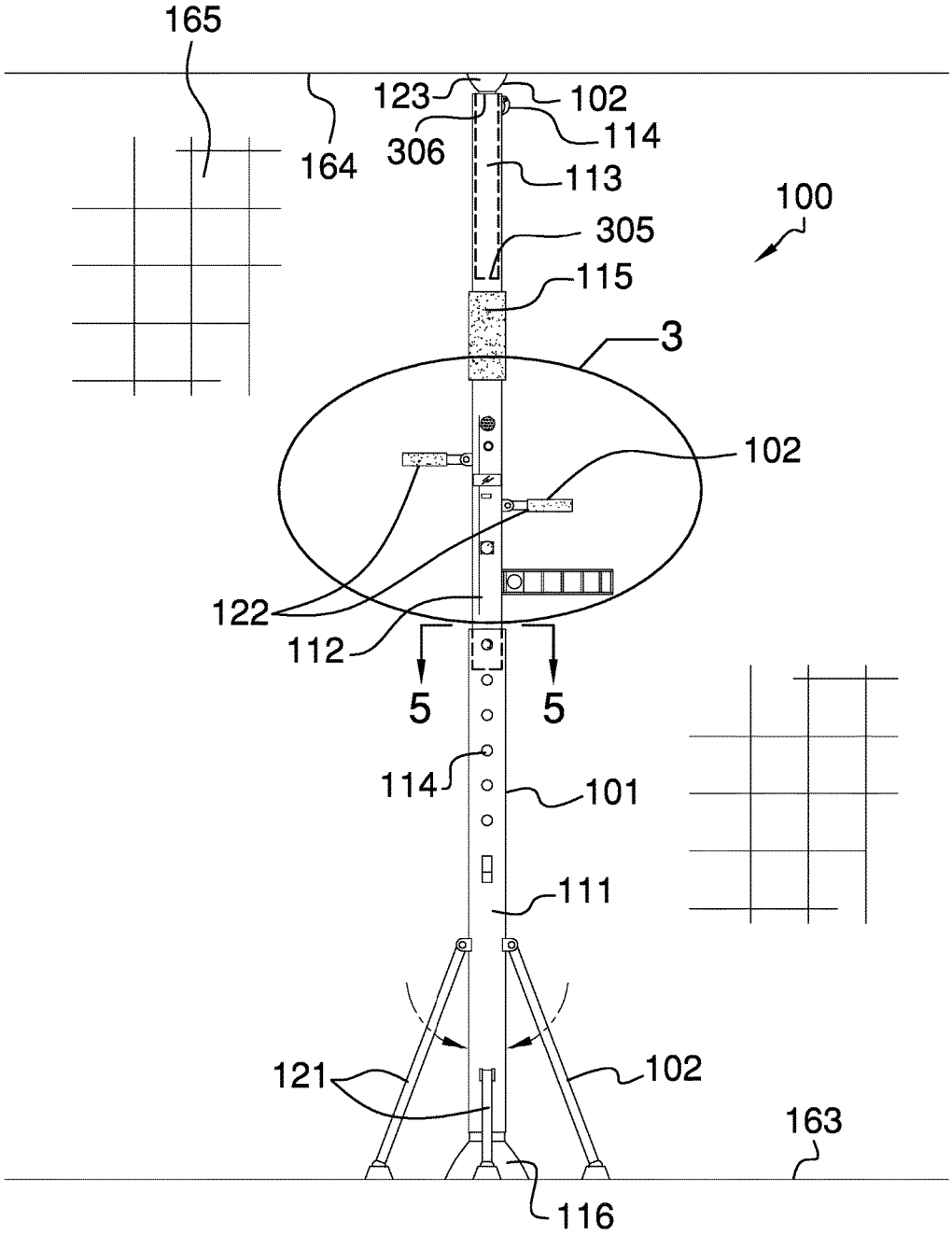
FIG. 1 is a front view of an embodiment of the disclosure.
Figure 2:
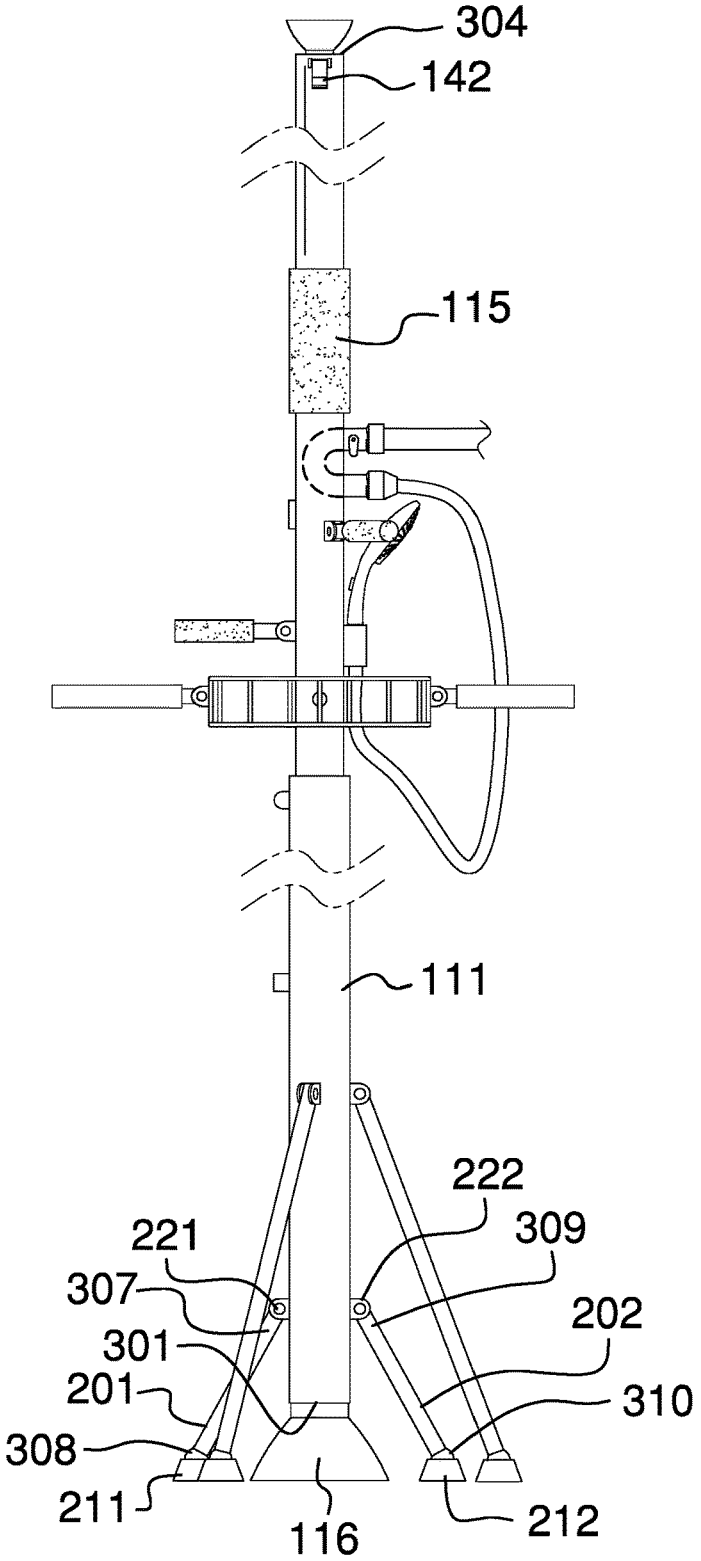
FIG. 2 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 12.

The bathroom support system 100 (hereinafter invention) is a stability assistance device. The invention 100 is configured for use in a bathing structure 165 selected from the group consisting of a bathtub or a shower. The invention 100 is removably installed in the bathing structure 165. The invention 100 is adapted for use by an individual. The individual uses the invention 100 as a supporting structure by holding onto the invention 100 during bathing activities.

The invention 100 comprises a telescopic structure 101, a plurality of supports 102, and an alarm system 103. The plurality of supports 102 and the alarm system 103 attach to the telescopic structure 101. The telescopic structure 101 adjusts the size of the invention 100 to match the space provided in the bathing structure 165. The plurality of supports 102: 1) stabilize the invention 100; and, 2) provide anchor points which are grasped by the individual for stabilization. The alarm system 103 is a safety device that allows the individual to call for assistance from an appropriate authority 162 if it is required. The appropriate authority 162 refers to one or more entities whom have been previously designated to receive SMS messages from the alarm system 103.

The telescopic structure 101 is a stanchion that provides the primary structural support of the invention 100. The span of the length of the telescopic structure 101 in the superior-inferior direction is adjustable. The span of the length of the telescopic structure 101 is selected such that the telescopic structure 101 wedges into the space between the supporting surface 163 and the ceiling 164 of the bathing structure 165. The supporting surface 163 refers to the inferior surface of the bathing structure 165. The ceiling 164 refers to the superior surface of the bathing structure 165.

The telescopic structure 101 comprises a first arm 111, a second arm 112, a third arm 113, a plurality of detents 114, a stanchion grip 115, and a pedestal 116. The first arm 111 is further defined with a first end 301 and a second end 302. The second arm 112 is further defined with a third end 303 and a fourth end 304. The third arm 113 is further defined with a fifth end 305 and a sixth end 306.

Each of the plurality of detents 114 is a mechanical structure used to assemble the telescopic structure 101. The plurality of detents 114 comprises a first detent 141 and a second detent 142.

The telescopic structure 101 further comprises a first arm 111, a second arm 112 and the first detent 141. The first detent 141 connects the second arm 112 to the first arm 111. The first arm 111 is a hollow first prism that is further defined with an inner dimension. The second arm 112 is a hollow second prism that is further defined with an outer dimension. The first arm 111 and the second arm 112 are geometrically similar. The outer dimension of the second arm 112 is less than the inner dimension of the first arm 111 such that the second arm 112 can be inserted into the first arm 111 in a telescopic manner. This telescopic arrangement of the telescopic structure 101 allows the length of the telescopic structure 101 to be adjusted by adjusting the relative position of the second arm 112 within the first arm 111. The position of the second arm 112 relative to the first arm 111 is held in position using the first detent 141. The first detent 141 is a mechanical device that connects and secures the first arm 111 to the second arm 112. As shown most clearly in FIGS. 7 to 12, the first detent 141 is selected from the group consisting of a cotter pin 251, a G snap collar 252, a cam lock collar 253, a threaded clutch 254, a split collar lock 255, or a spring loaded ball lock 256.

The telescopic structure 101 further comprises a third arm 113 and the second detent 142. The second detent 142 connects the third arm 113 to the second arm 112. The second arm 112 is further defined with an inner dimension. The third arm 113 is a third prism that is further defined with an outer dimension. The second arm 112 and the third arm 113 are geometrically similar. The outer dimension of the third arm 113 is less than the inner dimension of the second arm 112 such that the third arm 113 can be inserted into the second arm 112 in a telescopic manner. This telescopic arrangement of the telescopic structure 101 allows the length of the telescopic structure 101 to be adjusted by adjusting the relative position of the third arm 113 within the second arm 112. The position of the third arm 113 relative to the second arm 112 is held in position using the second detent 142. The second detent 142 is a mechanical device that connects and secures the second arm 112 to the third arm 113. As shown most clearly in FIG. 4, the second detent 142 comprises a ratchet system further comprising a ratchet bar 151 and a pawl 152. The ratchet bar 151 forms the third arm 113. The pawl 152 attaches to the second arm 112 such that the pawl 152 engages the ratchet bar 151 to lock the third arm 113 into position relative to the second arm 112.

The stanchion grip 115 is a neoprene covering that provides a non-skid grip location on the telescopic structure 101. The pedestal 116 is a non-skid structure that attaches to the telescopic structure 101. The pedestal 116 forms the final link of the load path between the invention 100 and the supporting surface 163 of the bathing structure 165.

Each of the plurality of supports 102 is a prism-shaped strut. Each of the plurality of supports 102 performs a function selected from the group consisting of: 1) providing lateral support to the telescopic structure 101; and, 2) providing anchor points used by an individual for stabilization. Each of the plurality of supports 102 rotates such that the center axis of each of the plurality of supports 102 will align with the center axis of the telescopic structure 101. Each of the plurality of supports 102 can be locked into a fixed position. The plurality of supports 102 comprises a plurality of legs 121, a plurality of handles 122, and a superior support 123.

Each of the plurality of legs 121 is a prism-shaped strut that provides lateral stability to the telescopic structure 101. The plurality of legs 121 comprises a first leg 201, a second leg 202, a third leg 203, a fourth leg 204, and a fifth leg 205. The first leg 201, the second leg 202, the third leg 203, the fourth leg 204, and the fifth leg 205 will not necessarily have the same span of length.

The first leg 201 is a commercially available strut. The first leg 201 further comprises a first locking hinge 221 and a first end cap 211. The first leg 201 is further defined with a seventh end 307 and an eighth end 308. The first end cap 211 is a commercially available non-skid furniture cap that protects the supporting surface 163 of the bathing structure 165 from damage. The first locking hinge 221 is a commercially available hinge. The first locking hinge 221 can be locked into a fixed position.

The second leg 202 is a commercially available strut. The second leg 202 further comprises a second locking hinge 222 and a second end cap 212. The second leg 202 is further defined with a ninth end 309 and a tenth end 310. The second end cap 212 is a commercially available non-skid furniture cap that protects the supporting surface 163 of the bathing structure 165 from damage. The second locking hinge 222 is a commercially available hinge. The second locking hinge 222 can be locked into a fixed position.

The third leg 203 is a commercially available strut. The third leg 203 further comprises a third locking hinge 223 and a third end cap 213. The third leg 203 is further defined with an eleventh end 311 and a twelfth end 312. The third end cap 213 is a commercially available non-skid furniture cap that protects the supporting surface 163 of the bathing structure 165 from damage. The third locking hinge 223 is a commercially available hinge. The third locking hinge 223 can be locked into a fixed position.

The fourth leg 204 is a commercially available strut. The fourth leg 204 further comprises a fourth locking hinge 224 and a fourth end cap 214. The fourth leg 204 is further defined with a thirteenth end 313 and a fourteenth end 314. The fourth end cap 214 is a commercially available non-skid furniture cap that protects the supporting surface 163 of the bathing structure 165 from damage. The fourth locking hinge 224 is a commercially available hinge. The fourth locking hinge 224 can be locked into a fixed position.

The fifth leg 205 is a commercially available strut. The fifth leg 205 further comprises a fifth locking hinge 225 and a fifth end cap 215. The fifth leg 205 is further defined with a fifteenth end 315 and a sixteenth end 316. The fifth end cap 215 is a commercially available non-skid furniture cap that protects the supporting surface 163 of the bathing structure 165 from damage. The fifth locking hinge 225 is a commercially available hinge. The fifth locking hinge 225 can be locked into a fixed position.

Each of the plurality of handles 122 is a prism-shaped strut that provides anchor points used for stabilization. The plurality of handles 122 comprises a first handle 231, a second handle 232, and a third handle 233.

The first handle 231 is a commercially available strut. The first handle 231 further comprises a sixth locking hinge 226 and a first handle grip 241. The first handle 231 is further defined with a seventeenth end 317 and an eighteenth end 318. The sixth locking hinge 226 is a commercially available hinge. The sixth locking hinge 226 can be locked into a fixed position. The first handle grip 241 is a neoprene covering that provides a non-skid surface on the first handle 231.

The second handle 232 is a commercially available strut. The second handle 232 further comprises a seventh locking hinge 227 and a second handle grip 242. The second handle 232 is further defined with a nineteenth end 319 and a twentieth end 320. The seventh locking hinge 227 is a commercially available hinge. The seventh locking hinge 227 can be locked into a fixed position. The second handle grip 242 is a neoprene covering that provides a non-skid surface on the second handle 232.

The third handle 233 is a commercially available strut. The third handle 233 further comprises an eighth locking hinge 228 and a third handle grip 243. The third handle 233 is further defined with a twenty-first end 321 and a twenty-second end 322. The eighth locking hinge 228 is a commercially available hinge. The eighth locking hinge 228 can be locked into a fixed position. The third handle grip 243 is a neoprene covering that provides a non-skid surface on the third handle 233.

The superior support 123 is a non-skid structure that attaches to the telescopic structure 101. The superior support 123 wedges against the ceiling 164 of the bathing structure 165 during normal use of the invention 100.

The alarm system 103 is an automated safety device that allows an individual to send an SMS message to an appropriate authority 162 requesting assistance. The alarm system 103 comprises a logic module 131, a communication module 132, a GPS module 133, an activation switch 134, and a wireless connection 135. The alarm system 103 is installed in the hollow interior of the second arm 112.

The logic module 131 is a readily and commercially available programmable electronic device that is used to manage, regulate, and operate the alarm system 103. Depending on the specific design and the selected components, the logic module 131 can be a separate component within the alarm system 103 or the functions of the logic module 131 can be incorporated into another component within the alarm system 103.

The communication module 132 is a wireless electronic communication device that allows the logic module 131 to wirelessly communicate SMS and MMS messages between the logic module 131 and the appropriate authority 162 through a wireless connection 135 with a commercially provided and publicly available cellular wireless network 161. The use of a commercially provided and publicly available cellular wireless network 161 is preferred because: 1) of its low cost; 2) of the widespread availability and the broad interoperability between competing commercially provided and publicly available cellular wireless networks 161; and, 3) methods and techniques to send SMS and MMS messages over a commercially provided and publicly available cellular wireless network 161 are well known and documented by those skilled in the electrical arts.

The GPS module 133 is an electrical device that communicates with the GPS to determine the GPS coordinates of the GPS module 133. When queried by the logic module 131, the GPS module 133 transfers the GPS coordinates to the logic module 131.

The activation switch 134 is a normally open momentary switch. The logic module 134 monitors the status of the activation switch. The activation switch 134 is located near the plurality of handles 122 such that the activation switch 134 can be accessed from the exterior surfaces of the telescopic structure 101. When the activation switch 134 is actuated, the logic module 131 queries the GPS module 133 for the GPS coordinates of the GPS module 133 and sends an SMS message over the wireless connection 135 and through the commercially provided and publicly available cellular wireless network 161 to the appropriate authority 162. The SMS message comprises a request for help and the GPS coordinates provided by the GPS module 133.

In a second potential embodiment of the disclosure, the second arm 112 further comprises a basket 261 a basket 261 screw 262, a first towel rack 263, a first towel rack 263 pivot 264, a second towel rack 265, a second towel rack 265 pivot 266, a first male threaded connection 267, a second male threaded connection 268, a bridge pipe 269, a shower head 270, a hose 271, a first female threaded connection 272, and a shower clip 273.

The basket 261 screw 262 attaches the basket 261 to the second arm 112. The first towel rack 263 pivot 264 attaches the first towel rack 263 to the basket. The second towel rack 265 pivot 266 attaches the second towel rack 265 to the basket 261. The first male threaded connection 267 and the second male threaded connection 268 attach to the second arm 112. The bridge pipe 269 forms a fluidic connection between the first male threaded connection 267 and the second male threaded connection 268. The hose 271 forms a fluidic connection between the shower head 270 and the first female threaded connection 272. The first female threaded connection 272 attaches to the second male threaded connection 268. The shower clip 273 removably attaches the shower head 270 to the second arm 112.

Figure 3:
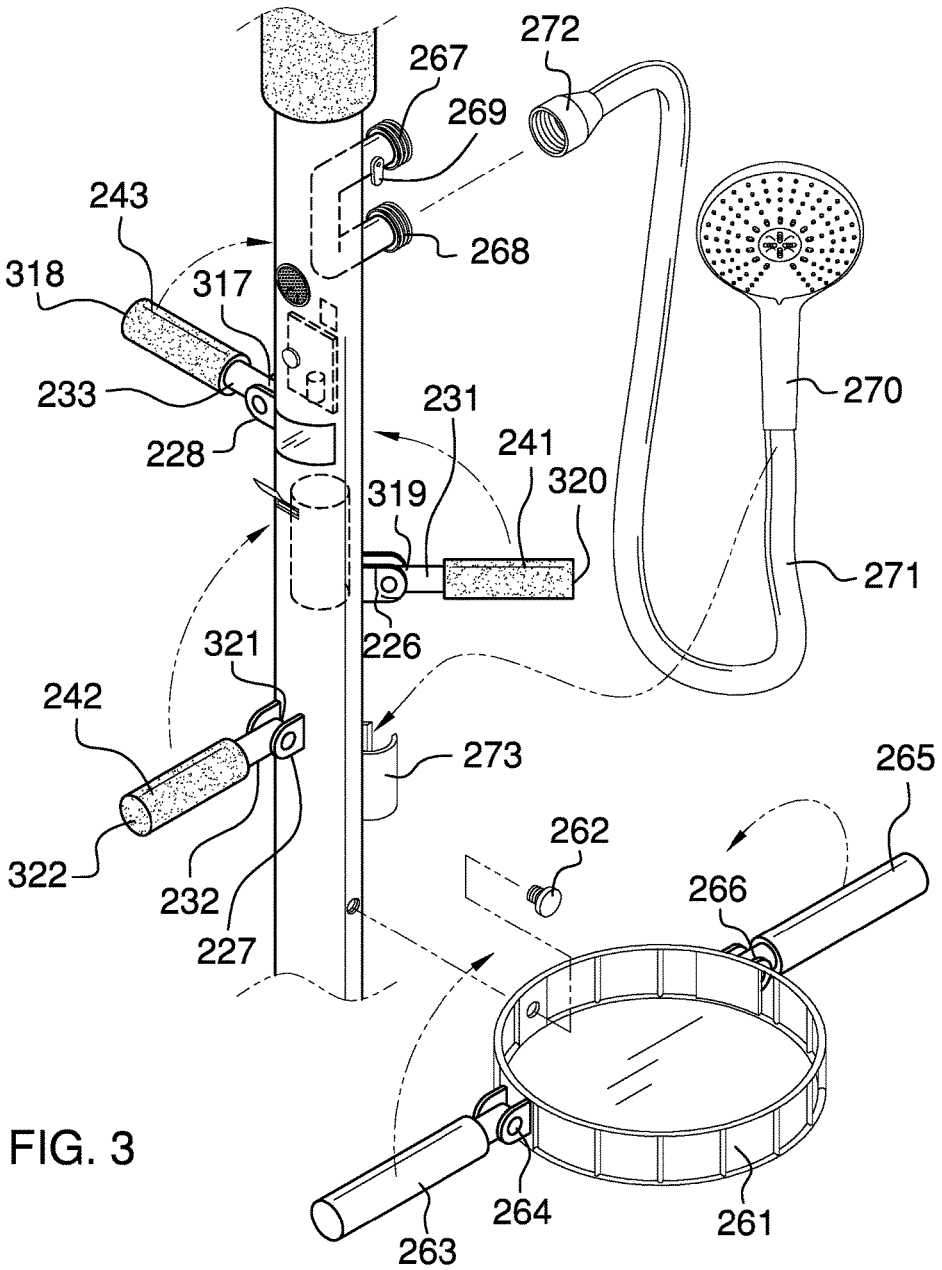
FIG. 3 is a detail view of an embodiment of the disclosure.
Figure 4:
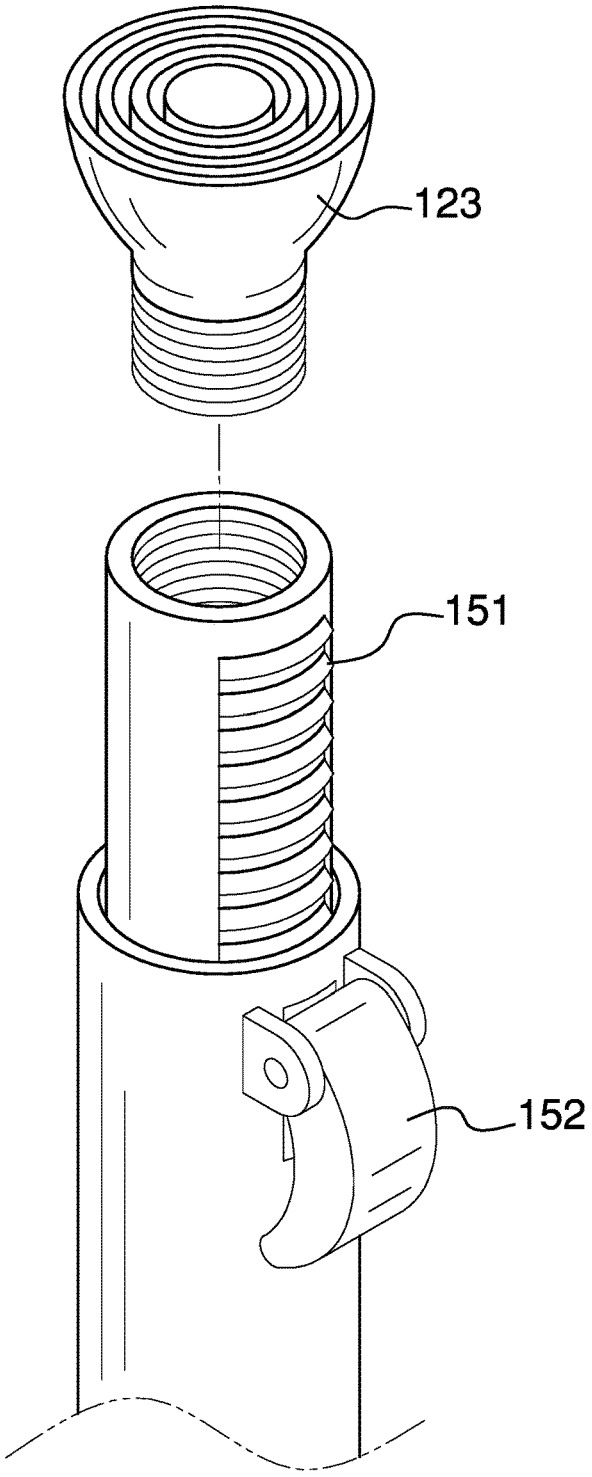
FIG. 4 is a detail view of an embodiment of the disclosure.
Figure 5:
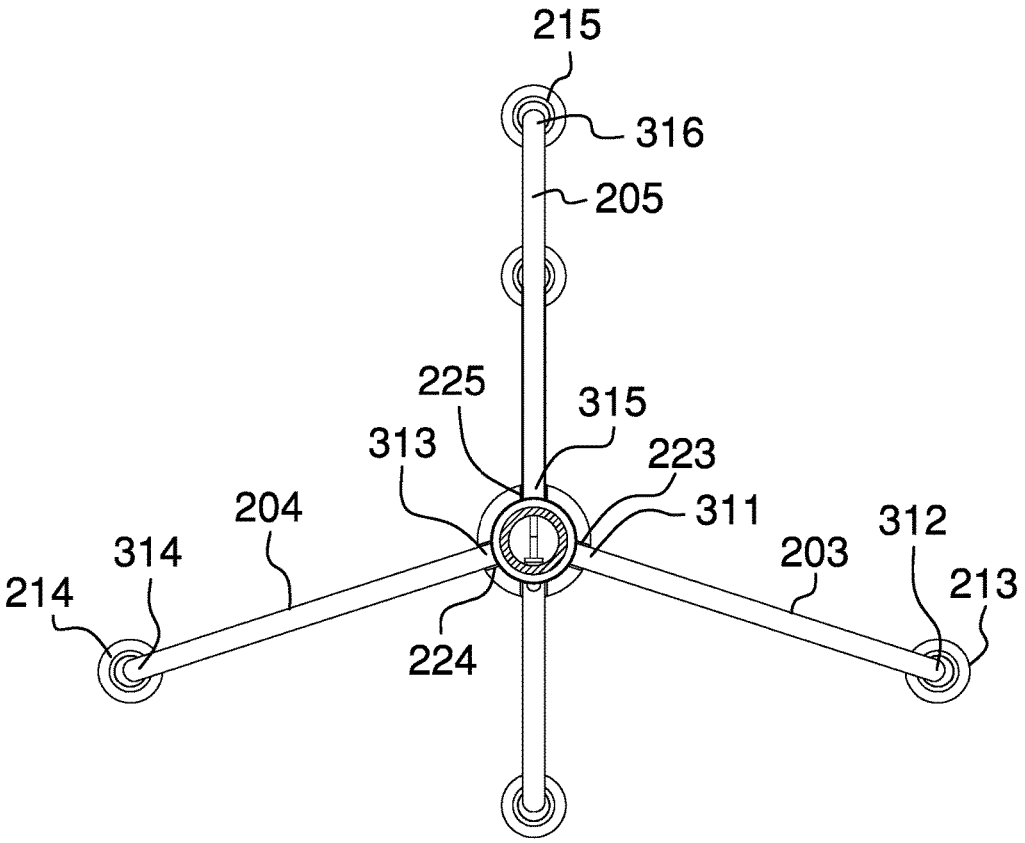
FIG. 5 is a top cross-sectional view of an embodiment of the disclosure across 5-5 as shown in FIG. 1.
Figure 6:
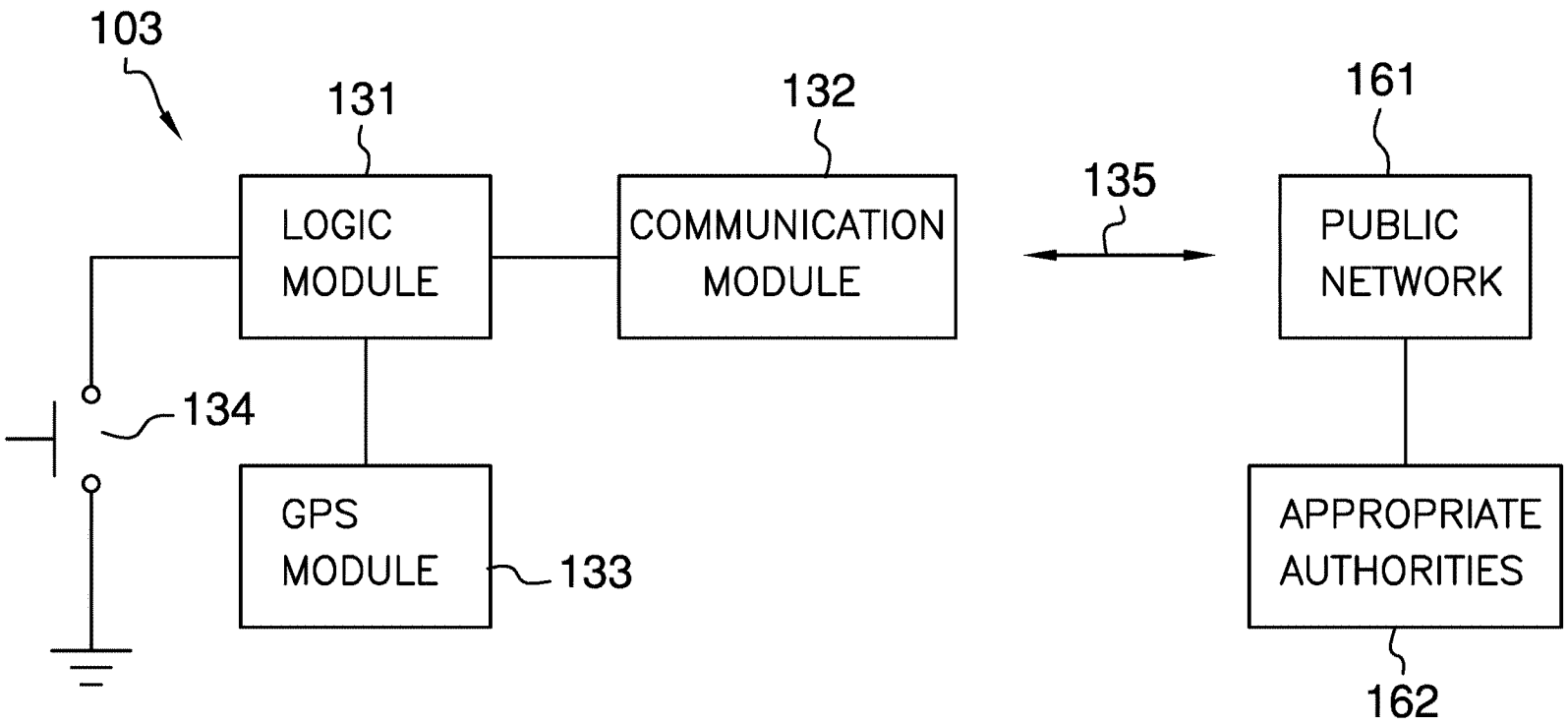
FIG. 6 is a block diagram of an embodiment of the disclosure.
Figure 7:
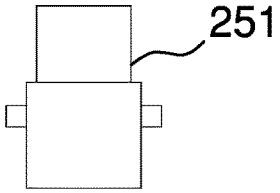
FIG. 7 is a detail view of an embodiment of the disclosure.
Figure 12:
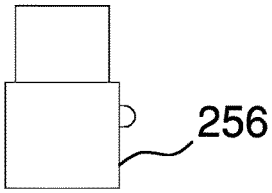
FIG. 12 is a detail view of an embodiment of the disclosure.
Figure 8:
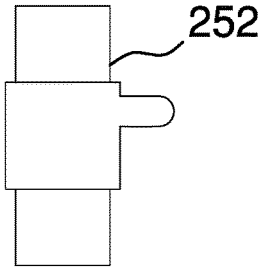
FIG. 8 is a detail view of an embodiment of the disclosure.
Figure 11:
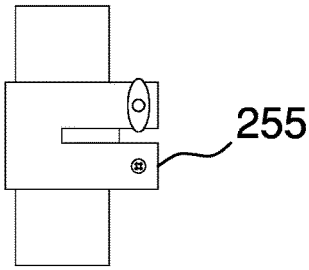
FIG. 11 is a detail view of an embodiment of the disclosure.
Figure 9:
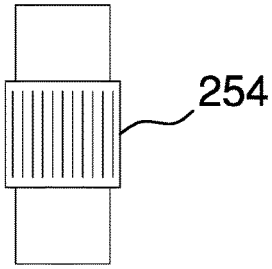
FIG. 9 is a detail view of an embodiment of the disclosure.
Figure 10:
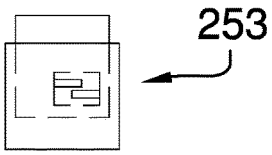
FIG. 10 is a detail view of an embodiment of the disclosure.

As shown most clearly in FIG. 3, the basket 261 is an openwork container that is used to store bathing items. The basket 261 screw 262 is a commercially available hardware item that attaches the basket 261 to the second arm 112. The first towel rack 263 is a shaft used to hang a textile such as a wash cloth or a towel. The first towel rack 263 pivot 264 attaches the first towel rack 263 to the basket 261 such that the first towel rack 263 will rotate into and out of the basket. The second towel rack 265 is a shaft used to hang a textile such as a wash cloth or a towel. The second towel rack 265 pivot 266 attaches the second towel rack 265 to the basket 261 such that the second towel rack 265 will rotate into and out of the basket.

The first male threaded connection 267 is a fitting that forms a fluidic connection with a hose that transfers water to the first male threaded connection 267 from the domestic water supply. The second male threaded connection 268 is a fitting that forms a fluidic connection with the first female threaded connection 272 such that a fluidic connection between the second male threaded connection 268 and the shower head 270 through the hose 271. The bridge pipe 269 forms a fluidic connection between the first male threaded connection 267 and the second male fluidic connection 268 such that water from the domestic supply will flow to the shower head 270.

The shower head 270 is a commercially available valve through which water from the domestic water supply flows for bathing purposes. The hose 271 is a commercially available flexible tube. The clip 272 is a mechanical device that attaches the shower head 270 to the second arm 112.

The following ten paragraphs describe the assembly of the first potential embodiment of the disclosure.

The third end 303 of the second arm 112 inserts into the second end 302 of the first arm 111 and is locked in position by the first detent 141. The fifth end 305 of the third arm 113 inserts into the fourth end 304 of the second arm 112 and is locked in position by the second detent 142. The pedestal 116 attaches to the first end 301 of the first arm 111.

The first locking hinge 221 attaches the seventh end 307 of the first leg 201 to the lateral face of the first arm 111 such that the first leg 201 will rotate to a position that aligns the center axis of the first leg 201 with the center axis of the first arm 111. The first leg 201 is locked into position using the first locking hinge 221.

The second locking hinge 222 attaches the ninth end 309 of the second leg 202 to the lateral face of the first arm 111 such that the second leg 202 will rotate to a position that aligns the center axis of the second leg 202 with the center axis of the first arm 111. The second leg 202 is locked into position using the second locking hinge 222.

The third locking hinge 223 attaches the eleventh end 311 of the third leg 203 to the lateral face of the first arm 111 such that the third leg 203 will rotate to a position that aligns the center axis of the third leg 203 with the center axis of the first arm 111. The third leg 203 is locked into position using the third locking hinge 223.

The fourth locking hinge 224 attaches the thirteenth end 313 of the fourth leg 204 to the lateral face of the first arm 111 such that the fourth leg 204 will rotate to a position that aligns the center axis of the fourth leg 204 with the center axis of the first arm 111. The fourth leg 204 is locked into position using the fourth locking hinge 224.

The fifth locking hinge 225 attaches the fifteenth end 315 of the fifth leg 205 to the lateral face of the first arm 111 such that the fifth leg 205 will rotate to a position that aligns the center axis of the fifth leg 205 with the center axis of the first arm 111. The fifth leg 205 is locked into position using the fifth locking hinge 225.

The sixth locking hinge 226 attaches the seventeenth end 317 of the first handle 231 to the lateral face of the second arm 112 such that the first handle 231 will rotate to a position that aligns the center axis of the first handle 231 with the center axis of the second arm 112. The first handle 231 is locked into position using the sixth locking hinge 226.

The seventh locking hinge 227 attaches the nineteenth end 319 of the second handle 232 to the lateral face of the second arm 112 such that the second handle 232 will rotate to a position that aligns the center axis of the second handle 232 with the center axis of the second arm 112. The second handle 232 is locked into position using the seventh locking hinge 227.

The eighth locking hinge 228 attaches the twenty-first end 321 of the third handle 233 to the lateral face of the second arm 112 such that the third handle 233 will rotate to a position that aligns the center axis of the third handle 233 with the center axis of the second arm 112. The third handle 233 is locked into position using the eighth locking hinge 228.

The first end cap 211 attaches to the eighth end 308 of the first leg 201. The second end cap 212 attaches to the tenth end 310 of the second leg 202. The third end cap 213 attaches to the twelfth end 312 of the third leg 203. The fourth end cap 214 attaches to the fourteenth end 314 of the fourth leg 204. The fifth end cap 215 attaches to the sixteenth end 316 of the fifth leg 205. The first handle grip 241 attaches to the eighteenth end 318 of the first handle 231. The second handle grip 242 attaches to the twentieth end 320 of the second handle 232. The third handle grip 243 attaches to the twenty-second end 322 of the third handle 233. The stanchion grip 115 attaches to the fourth end 304 of the second arm 112. The superior support 123 attaches to the sixth end 306 of the third arm 113.

The following definitions were used in this disclosure:

Appropriate Authority: As used in this disclosure, an appropriate authority is a previously determined person or organization that is designated to receive an alarm or other notification messages regarding a monitored system or activity.

Ceiling: As used in this disclosure a ceiling refers to either: 1) the superior horizontal surface of a room that is distal from the floor; 2) the superior horizontal surface of a structure; or, 3) the upper limit of a range. A floor and a ceiling can be used to the same structure where the selection depends solely on the point of view of the user. The selection of this definition depends on the context. In situations where the context is unclear the first definition should be used.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Detent: As used in this disclosure, a detent is a device for positioning and holding a first object relative to a second object such that the position of the first object relative to the second object is adjustable.

Fitting: As used in this disclosure, a fitting is a component that is attached to a first object. The fitting is used to forming a fluidic connection between the first object and a second object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

GPS: As used in this disclosure, and depending on the context, GPS refers to: 1) a system of navigational satellites that are used to determine the position and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System.

Hinge: As used in this disclosure, a hinge is a device that permits the turning, rotating, or pivoting of a first object relative to a second object.

Inferior: As used in this disclosure, the term inferior refers to a directional reference that is parallel to and in the same direction as the force of gravity.

Inner Dimension: As used in this disclosure, the term inner dimension describes the span from a first inside or interior surface of a container to a second inside or interior surface of a container. The term is used in much the same way that a plumber would refer to the inner diameter of a pipe.

Load Path: As used in this disclosure, a load path refers to a chain of one or more structures that transfers a load generated by a raised structure or object to a foundation, supporting surface, or the earth.

Lock: As used in this disclosure, a lock is a device that prevents the unauthorized operation of a device.

Logic Module: As used in this disclosure, a logic module is a readily and commercially available electrical device that is programmable and that accepts digital and analog inputs, processes the digital and analog inputs according to previously stored instruction and provides the results of these instructions as digital or analog outputs.

Momentary Switch: As used in this disclosure, a momentary switch is a biased switch in the sense that the momentary switch has a baseline position that only changes when the momentary switch is actuated (for example when a pushbutton switch is pushed). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Non-Skid Material: As used in this disclosure, a non-skid material is a material or structure that can be applied to an object such that the object is inhibited from sliding along the surface upon which the object is resting. Non-skid materials are often, but not always, adhesive or abrasive materials.

Openwork: As used in this disclosure, the term open work is used to describe a structure, often a surface, which is formed with openings that allow for visibility and airflow through the structure. Wrought work and meshes are forms of openwork.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pawl: As used in this disclosure, a pawl is a rotating bar or lever with a free end that engages a toothed structure.

Pedestal: As used in this disclosure, a pedestal is an intermediary load bearing structure that that transfers a load path between a supporting surface and an object, structure, or load.

Pivot: As used in this disclosure, a pivot is a rod or shaft around which an object rotates or swings.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called that lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Ratchet: As used in this disclosure, a ratchet is a device comprising a pawl or hinged catch that engages the sloping teeth of a wheel or bar permitting motion in one direction only.

Stanchion: As used in this disclosure, a stanchion refers to a vertical pole, post, or support.

Superior: As used in this disclosure, the term superior refers to a directional reference that is parallel to and in the opposite direction of the force of gravity.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Telescopic: As used in this disclosure, telescopic is an adjective that describes an object made of sections that fit or slide into each other such that the object can be made longer or shorter by adjusting the relative positions of the sections.

Wedge: As used in this disclosure, to wedge is a verb that refers to forcing an object into a space that is slightly smaller than the object itself.

Wireless: As used in this disclosure, wireless is an adjective that is used to describe a communication channel between two terminals that does not require the use of physical cabling.

With respect to the above description, it is to be realized that the optimum dimensional relationship for the various components of the invention described above and in FIGS. 1 through 12 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A stability assistance device comprising:
a telescopic structure, a plurality of supports, and an alarm system;
wherein the plurality of supports and the alarm system attach to the telescopic structure;
wherein the stability assistance device is configured for use in a bathing structure;
wherein the stability assistance device is removably installed in the bathing structure;
wherein the telescopic structure adjusts the size of the stability assistance device to match the size of the bathing structure;
wherein the plurality of supports stabilize the stability assistance device;
wherein the plurality of supports provide anchor points for stabilization;
wherein the alarm system is a safety device that sends messages to an appropriate authority;
wherein the telescopic structure is a stanchion;
wherein the span of the length of the telescopic structure in the superior-inferior direction is adjustable;
wherein the span of the length of the telescopic structure is selected such that the telescopic structure wedges into the space between the supporting surface and the ceiling of the bathing structure;
wherein each of the plurality of supports is a prism-shaped strut;
wherein each of the plurality of supports performs a function selected from the group consisting of: A) providing lateral support to the telescopic structure; and, B) providing anchor points for stabilization;
wherein each of the plurality of supports rotates such that the center axis of each of the plurality of supports will align with the center axis of the telescopic structure;
wherein each of the plurality of supports can be locked into a fixed position;
wherein the plurality of supports further comprises a plurality of legs, a plurality of handles, and a superior support.

2. The stability assistance device according to claim 1
wherein the alarm system is an automated safety device;
wherein the alarm system sends an SMS message to the appropriate authority.

3. The stability assistance device according to claim 2
wherein the telescopic structure comprises a first arm, a second arm, a third arm, a plurality of detents, a stanchion grip, and a pedestal;
wherein the plurality of detents interconnect the first arm, the second arm, and the third arm;
wherein the stanchion grip attaches to the second arm;
wherein the pedestal attaches to the first arm;
wherein each of the plurality of detents is a mechanical structure;
wherein the plurality of detents comprises a first detent and a second detent;
wherein the first arm is further defined with a first end and a second end;
wherein the second arm is further defined with a third end and a fourth end;
wherein the third arm is further defined with a fifth end and a sixth end.

4. The stability assistance device according to claim 3
wherein the telescopic structure further comprises a first arm, a second arm, and the first detent;
wherein the first arm is a hollow first prism that is further defined with an inner dimension;
wherein the second arm is a hollow second prism that is further defined with an outer dimension;
wherein the first arm and the second arm are geometrically similar.

5. The stability assistance device according to claim 4
wherein the outer dimension of the second arm is less than the inner dimension of the first arm such that the second arm telescopically inserts into the first arm;
wherein the length of the telescopic structure is changed by adjusting the relative position of the second arm within the first arm;
wherein the position of the second arm relative to the first arm is held in position using the first detent;
wherein the first detent is selected from the group consisting of a cotter pin, a g snap collar, a cam lock collar, a threaded clutch, a split collar lock, or a spring loaded ball lock.

6. The stability assistance device according to claim 5
wherein the telescopic structure further comprises a third arm and the second detent;
wherein the second arm is further defined with an inner dimension;
wherein the third arm is a third prism that is further defined with an outer dimension;
wherein the second arm and the third arm are geometrically similar.

7. The stability assistance device according to claim 6
wherein the outer dimension of the third arm is less than the inner dimension of the second arm such that the third arm telescopically inserts into the second arm;
wherein the length of the telescopic structure is changed by adjusting the relative position of the third arm within the second arm;
wherein the position of the third arm relative to the second arm is held in position using the second detent;
wherein the second detent comprises a ratchet system further comprising a ratchet bar and a pawl;
wherein the ratchet bar forms the third arm.

8. The stability assistance device according to claim 7
wherein the plurality of legs comprises a first leg, a second leg, a third leg, a fourth leg, and a fifth leg;
wherein the plurality of handles comprises a first handle, a second handle, and a third handle;

wherein each of the plurality of legs provides lateral stability to the telescopic structure;

wherein each of the plurality of handles anchor points used for stabilization.

9. The stability assistance device according to claim 8 wherein the first leg is a strut;

wherein the first leg further comprises a first locking hinge and a first end cap;

wherein the first leg is further defined with a seventh end and an eighth end;

wherein the first locking hinge is a hinge;

wherein the first locking hinge can be locked into a fixed position;

wherein the second leg is a strut;

wherein the second leg further comprises a second locking hinge and a second end cap;

wherein the second leg is further defined with a ninth end and a tenth end;

wherein the second locking hinge is a hinge;

wherein the second locking hinge can be locked into a fixed position;

wherein the third leg is a strut;

wherein the third leg further comprises a third locking hinge and a third end cap;

wherein the third leg is further defined with an eleventh end and a twelfth end;

wherein the third locking hinge is a hinge;

wherein the third locking hinge can be locked into a fixed position;

wherein the fourth leg is a strut;

wherein the fourth leg further comprises a fourth locking hinge and a fourth end cap;

wherein the fourth leg is further defined with a thirteenth end and a fourteenth end;

wherein the fourth locking hinge is a hinge;

wherein the fourth locking hinge can be locked into a fixed position;

wherein the fifth leg is a strut;

wherein the fifth leg further comprises a fifth locking hinge and a fifth end cap;

wherein the fifth leg is further defined with a fifteenth end and a sixteenth end;

wherein the fifth locking hinge is a hinge;

wherein the fifth locking hinge can be locked into a fixed position.

10. The stability assistance device according to claim 9 wherein the first handle is a strut;

wherein the first handle further comprises a sixth locking hinge and a first handle grip;

wherein the first handle is further defined with a seventeenth end and an eighteenth end;

wherein the sixth locking hinge is a hinge;

wherein the sixth locking hinge can be locked into a fixed position;

wherein the first handle grip is a neoprene covering;

wherein the second handle is a strut;

wherein the second handle further comprises a seventh locking hinge and a second handle grip;

wherein the second handle is further defined with a nineteenth end and a twentieth end;

wherein the seventh locking hinge is a hinge;

wherein the seventh locking hinge can be locked into a fixed position;

wherein the second handle grip is a neoprene covering;

wherein the third handle is a strut;

wherein the third handle further comprises an eighth locking hinge and a third handle grip;

wherein the third handle is further defined with a twenty-first end and a twenty-second end;

wherein the eighth locking hinge is a hinge;

wherein the eighth locking hinge can be locked into a fixed position;

wherein the third handle grip is a neoprene covering.

11. The stability assistance device according to claim 10 wherein the superior support is a non-skid structure;

wherein the superior support wedges against the ceiling of the bathing structure.

12. The stability assistance device according to claim 11 wherein the alarm system comprises a logic module, a communication module, a GPS module, an activation switch, and a wireless connection;

wherein the logic module, the communication module, the GPS module, and the activation switch are electrically interconnected;

wherein the wireless connection forms a communication channel between a commercially provided and publicly available cellular wireless network and the communication module.

13. The stability assistance device according to claim 12 wherein the logic module is a programmable device;

wherein the communication module is a wireless electronic communication device;

wherein the communication module communicates SMS messages between the logic module and the appropriate authority through the wireless connection with the commercially provided and publicly available cellular wireless network.

14. The stability assistance device according to claim 13 wherein the GPS module is an electrical device;

wherein the GPS module communicates with the GPS to determine the GPS coordinates of the GPS module;

wherein the GPS module transfers the GPS coordinates to the logic module;

wherein the activation switch is a normally open momentary switch;

wherein the logic module monitors the status of the activation switch;

wherein the activation switch is located near the plurality of handles such that the activation switch can be accessed from the exterior surfaces of the telescopic structure;

wherein when the activation switch initiates the transmission of the SMS message.

15. The stability assistance device according to claim 14 wherein the SMS message comprises a request for help and the GPS coordinates provided by the GPS module.

16. The stability assistance device according to claim 15 wherein the alarm system is installed in the hollow interior of the second arm;

wherein the stanchion grip is a neoprene covering;

wherein the pedestal is a non-skid structure.

17. The stability assistance device according to claim 15 wherein the third end of the second arm inserts into the second end of the first arm and is locked in position by the first detent;

wherein the fifth end of the third arm inserts into the fourth end of the second arm and is locked in position by the second detent;

wherein the pedestal attaches to the first end of the first arm;

wherein the first locking hinge attaches the seventh end of the first leg to the lateral face of the first arm such that the first leg will rotate to a position that aligns the center axis of the first leg with the center axis of the first arm;

wherein the first leg is locked into position using the first locking hinge;

wherein the second locking hinge attaches the ninth end of the second leg to the lateral face of the first arm such that the second leg will rotate to a position that aligns the center axis of the second leg with the center axis of the first arm;

wherein the second leg is locked into position using the second locking hinge;

wherein the third locking hinge attaches the eleventh end of the third leg to the lateral face of the first arm such that the third leg will rotate to a position that aligns the center axis of the third leg with the center axis of the first arm;

wherein the third leg is locked into position using the third locking hinge;

wherein the fourth locking hinge attaches the thirteenth end of the fourth leg to the lateral face of the first arm such that the fourth leg will rotate to a position that aligns the center axis of the fourth leg with the center axis of the first arm;

wherein the fourth leg is locked into position using the fourth locking hinge;

wherein the fifth locking hinge attaches the fifteenth end of the fifth leg to the lateral face of the first arm such that the fifth leg will rotate to a position that aligns the center axis of the fifth leg with the center axis of the first arm;

wherein the fifth leg is locked into position using the fifth locking hinge;

wherein the sixth locking hinge attaches the seventeenth end of the first handle to the lateral face of the second arm such that the first handle will rotate to a position that aligns the center axis of the first handle with the center axis of the second arm;

wherein the first handle is locked into position using the sixth locking hinge;

wherein the seventh locking hinge attaches the nineteenth end of the second handle to the lateral face of the second arm such that the second handle will rotate to a position that aligns the center axis of the second handle with the center axis of the second arm;

wherein the second handle is locked into position using the seventh locking hinge;

wherein the eighth locking hinge attaches the twenty-first end of the third handle to the lateral face of the second arm such that the third handle will rotate to a position that aligns the center axis of the third handle with the center axis of the second arm;

wherein the third handle is locked into position using the eighth locking hinge;

wherein the first end cap attaches to the eighth end of the first leg;

wherein the second end cap attaches to the tenth end of the second leg;

wherein the third end cap attaches to the twelfth end of the third leg;

wherein the fourth end cap attaches to the fourteenth end of the fourth leg;

wherein the fifth end cap attaches to the sixteenth end of the fifth leg;

wherein the first handle grip attaches to the eighteenth end of the first handle;

wherein the second handle grip attaches to the twentieth end of the second handle;

wherein the third handle grip attaches to the twenty-second end of the third handle;

wherein the stanchion grip attaches to the fourth end of the second arm;

wherein the superior support attaches to the sixth end of the third arm;

wherein the alarm system is installed in the hollow interior of the second arm;

wherein the stanchion grip is a neoprene covering;

wherein the pedestal is a non-skid structure.

18. The stability assistance device according to claim 17 wherein the second arm further comprises a basket a basket screw, a first towel rack, a first towel rack pivot, a second towel rack, a second towel rack pivot, a first male threaded connection, a second male threaded connection, a bridge pipe, a shower head, a hose, a first female threaded connection, and a shower clip;

wherein the basket screw attaches the basket to the second arm;

wherein the first male threaded connection and the second male threaded connection attach to the second arm;

wherein the bridge pipe forms a fluidic connection between the first male threaded connection and the second male threaded connection;

wherein the hose forms a fluidic connection between the shower head and the first female threaded connection;

wherein the first female threaded connection attaches to the second male threaded connection;

wherein the shower clip removably attaches the shower head to the second arm;

wherein the basket is an openwork container that is used to store bathing items;

wherein the first towel rack is a shaft;

wherein the first towel rack pivot attaches the first towel rack to the basket such that the first towel rack will rotate into and out of the basket;

wherein the second towel rack is a shaft used to hang a textile such as a wash cloth or a towel;

wherein the second towel rack pivot attaches the second towel rack to the basket such that the second towel rack will rotate into and out of the basket;

wherein the bridge pipe forms a fluidic connection between the first male threaded connection and the second male fluidic connection such that water from the domestic supply will flow to the shower head;

wherein the shower head is a valve;

wherein the hose is a flexible tube.

* * * * *